US008369557B2

(12) United States Patent
Kuhtz et al.

(10) Patent No.: US 8,369,557 B2
(45) Date of Patent: Feb. 5, 2013

(54) EARPHONE AND HEADSET

(75) Inventors: Jan Peter Kuhtz, Celle (DE); Olav Nisse, Hildesheim (DE); Olaf Leske, Langenhagen (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 514 days.

(21) Appl. No.: 12/427,588

(22) Filed: Apr. 21, 2009

(65) Prior Publication Data

US 2009/0262952 A1 Oct. 22, 2009

(30) Foreign Application Priority Data

Apr. 22, 2008 (DE) ..... 10 2008 020 264

(51) Int. Cl.
*H04R 25/00* (2006.01)

(52) U.S. Cl. ..... 381/370; 381/374

(58) Field of Classification Search ..... 381/371, 381/374

See application file for complete search history.

(56) References Cited

U.S. PATENT DOCUMENTS

| | | | | |
|---|---|---|---|---|
| 4,156,118 | A * | 5/1979 | Hargrave | 381/372 |
| 4,302,635 | A * | 11/1981 | Jacobsen et al. | 381/371 |
| 5,497,427 | A * | 3/1996 | Nageno | 381/381 |
| 6,295,366 | B1 * | 9/2001 | Haller et al. | 381/374 |
| RE37,398 | E * | 10/2001 | Nageno | 381/371 |
| 6,466,681 | B1 * | 10/2002 | Siska et al. | 381/372 |
| 7,289,641 | B2 * | 10/2007 | Yang | 381/382 |
| 2006/0222197 | A1 * | 10/2006 | Tsunoda et al. | 381/371 |

* cited by examiner

*Primary Examiner* — Jeremy Luks

(74) *Attorney, Agent, or Firm* — Kilpatrick Townsend & Stockton LLP

(57) ABSTRACT

There is thus provided an earphone comprising a housing (20) for receiving an electroacoustic transducer, and an ear cushion unit (10) having an ear cushion material (11) and a first ring (1). The housing has a sealing ring (2) and a latching unit (21). The first ring (1) has a prestressing when it is placed on the sealing ring (2) and held by means of the latching unit (21).

10 Claims, 3 Drawing Sheets

EARPHONE AND HEADSET

CROSS-REFERENCE TO RELATED APPLICATIONS

Figure 1:
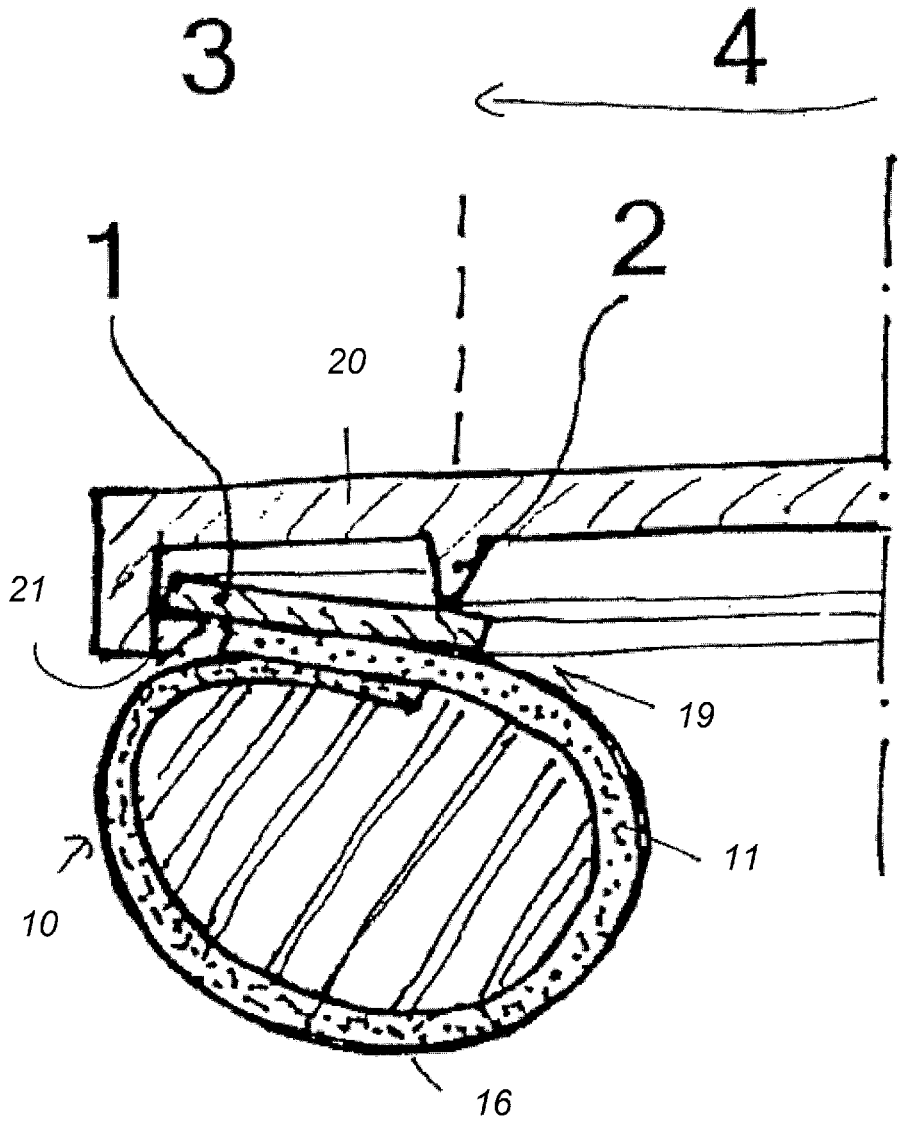

This application claims priority of German Patent Application No. 102008020264.9, filed Apr. 22, 2008, the disclosure of which is herein incorporated by reference in its entirety.

The present invention concerns an earphone and a headset.

Particularly in the case of closed earphones, it is important for the ear cushions to be fixed in well-sealed relationship to the transducer housing. For example earphones are known, in which the ear cushions are crimped on to the transducer housing or the resonator and that therefore provides good sealing integrity between the ear cushion and the housing.

Such a crimp solution however requires a high level of assembly complication and expenditure and a certain skill in assembly.

EP 0 414 525 A2 shows a headset having an ear cushion. The ear cushion has a flexible skin having a circumferential groove. In addition a thin flexible ring is attached to the circumferential groove. The arrangement further has a flexible rear skin and a foam ring on the rear skin. In addition there are a plurality of pins and a holding ring which projects beyond the outer region of the ear cushion. Accordingly the rearward region of the ear cushion bears against a housing and an outside region of the ear cushion is held by the holding ring.

U.S. Pat. No. 6,295,366 B1 shows a headset with an ear cushion having a plurality of snap hooks on the ear cushion. The ear cushion can be fixed to the housing by means of the snap hooks. That headset has in particular no sealed edge for improving the sealing integrity of the housing and the ear cushion.

U.S. Pat. No. 4,674,134 shows an earmuff. The earmuff has a sealing ring with an outer liquid layer and a foamed plastic layer. The earmuff further has a circular plate with an inwardly bent flange and an outwardly bent flange having a projection which extends towards the sealing ring. Thus a pressure is applied to the foamed ring in the radial direction by the inwardly bent flange and by the outer flange.

Therefore an object of the present invention is to provide an earphone in which an ear cushion can be fixed to the transducer housing in good sealing relationship.

That object is attained by an earphone as set forth in claim 1 and by a headset as set forth in claim 5.

Thus there is provided an earphone comprising a housing for receiving an electroacoustic transducer, and an ear cushion unit having an ear cushion material and a first ring. The housing has a sealing ring (the term 'sealing ring' is not limited to a circular configuration) and a latching unit. The first ring has a prestressing when it is placed on the sealing ring and held by means of the latching unit.

In accordance with an aspect of the present invention the ring plate engages into the latching unit and bears against the sealing ring in such a way that the ring plate represents a spring subjected to a force.

The invention also concerns a headset comprising a housing for receiving an electroacoustic transducer, and an ear cushion unit having an ear cushion material and a first ring. The housing has a sealing ring and a latching unit. The first ring has a prestressing when it is placed on the sealing ring and held by means of the latching unit.

The invention concerns the notion of providing an earphone with ear cushion, wherein the ear cushions are adapted to be optionally easily interchangeable and they permit an acoustically closed structure in respect of the transducer housing.

The invention concerns the notion of providing an earphone having (removable) ear cushions. In that case the ear cushions have a ring plate connected to a (soft) material of the ear cushion. In that arrangement the ring plate is latched in position to a housing for receiving the electroacoustic transducer or is fixed to the housing by means of a screwthread or by means of a bayonet fixing. Optionally the housing has a ring plate receiving unit which can have latching hooks or an undercut configuration. When the ring plate is arranged at or on the housing that results in a prestressing at the ring plate.

The invention concerns an earphone with (removable) ear cushions, wherein the ear cushions have a ring plate connected to a material of the ear cushion. In that arrangement the ring plate is disposed on a housing for receiving an electroacoustic transducer in such a way that an axial prestressing is provided. In that case in particular a seal can be provided between the ear cushion and the remaining housing or the housing for receiving the electroacoustic transducer. A seal between the ear cushion and the housing for receiving the electroacoustic transducer is advantageous in terms of the acoustic properties of the earphone.

Thus there can be provided an earphone having an ear cushion with a ring plate, wherein the ring plate is fixed in a prestressed condition (axially) in or at the housing for receiving the electroacoustic reproduction transducer.

Further configurations of the invention are subject-matter of the appendant claims.

Advantages and embodiments by way of example of the invention are described in greater detail hereinafter with reference to the drawing.

Figure 2:
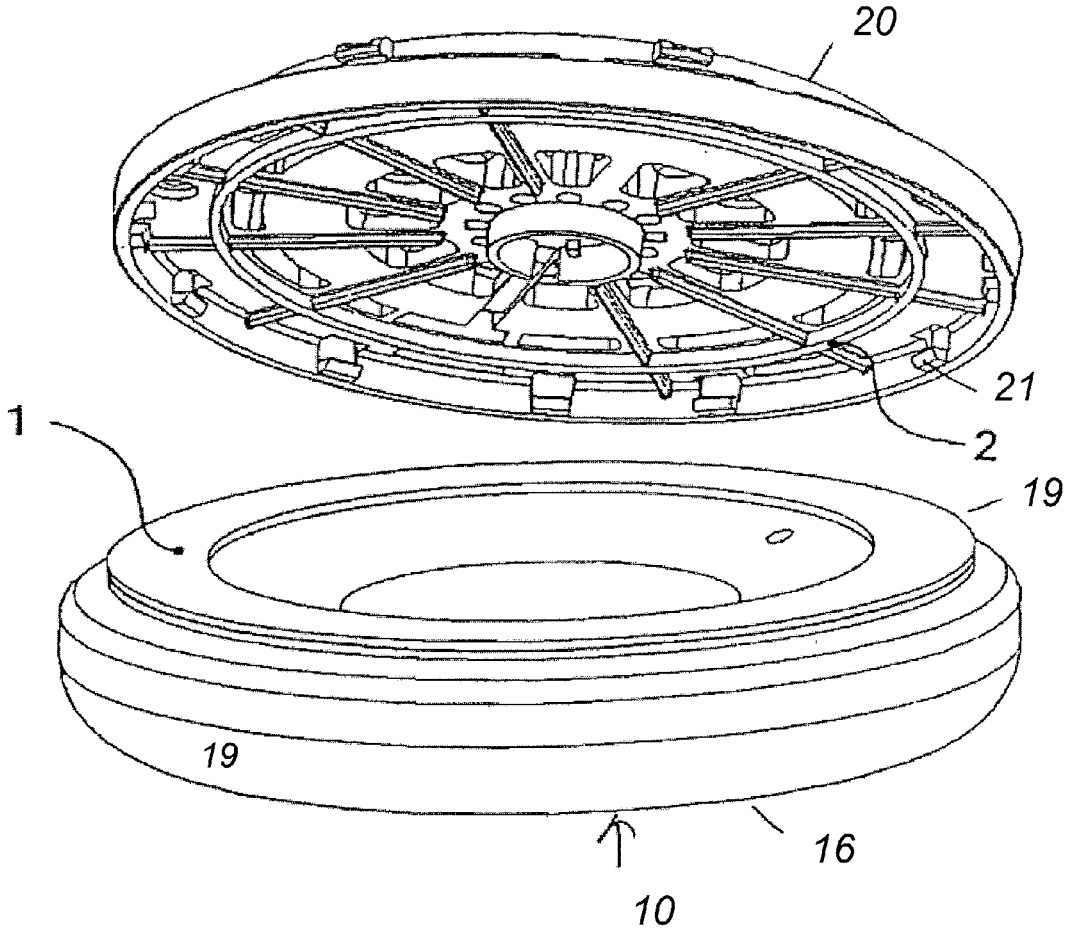
Figure 3:
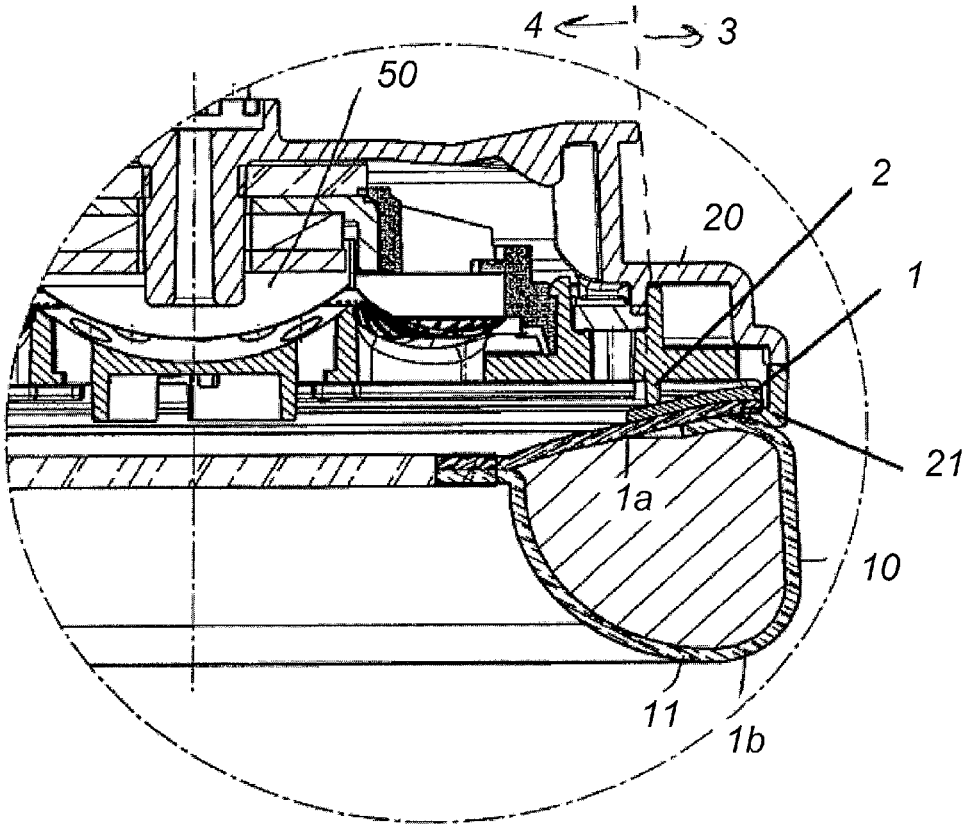

FIG. 1 shows a sectional view of an earphone in accordance with the first embodiment, FIG. 2 shows a perspective view of an earphone in accordance with the first embodiment, and FIG. 3 shows a sectional view of an earphone in accordance with a second embodiment.

FIG. 1 shows a sectional view of an earphone or a headset in accordance with the first embodiment. A housing 20 for receiving an electroacoustic transducer preferably has in its outer region a plurality of latching hooks 21 or a circumferential latching ring and an at least partially circumferentially extending receiving ring 2.

An ear cushion 10 of the earphone has an ear cushion substance or an ear cushion material 11 and a first side 1*a* towards the housing and a second side 1*b* towards the ear. The ear cushion 10 further has a ring plate 1 at the first side la. The ring plate 1 can be made from a hard material (and can extend at least partially circumferentially).

Accordingly the earphone has a sealing ring 3 for sealing off the ear cushion 10 in relation to the outer region of the housing 20 with the latching hook 21 and the circumferential ring 2. That makes it possible to provide an acoustically closed region 4 in the housing 20. The ring plate 1 can be latched for example into the latching hooks 21 along the circumference of the housing 10 and can bear against the sealing ring 2 so that the acoustically closed region 4 can be provided.

Instead of or in addition to the latching hooks 21 it is also possible to provide an undercut configuration at least partially at the circumference of the housing.

When the preferably hard ring plate 1 is fixed to the housing 20 by means of the latching hooks or the undercut configuration 2 the ring plate 1 acts as a spring, in which case a force is exerted on the spring by means of the sealing ring 2.

That force is preferably exerted on the spring (axially and) distributed along the circumference. By virtue of the axial prestressing exerted on the ring plate 1, the ring plate 1 is deformed, for example to the shape of the surface of a truncated cone. In that way a plate spring can be provided and acoustically sealed contact is achieved between the ring plate and the receiving ring 2.

In accordance with a further embodiment of the invention a soft sealing element such as for example an O-ring can be provided instead of or in addition to the sealing ring 2. Furthermore the housing 20 can be produced using a multi-component injection molding process so that the sealing ring 2 comprises a soft component while the remainder of the housing 20 comprises a hard component.

FIG. 2 shows a perspective view of a housing of an earphone in accordance with the first embodiment. The housing 20 serves to receive an electroacoustic transducer (not shown). At its circumference the housing 20 has a plurality of latching hooks 21 or alternatively an undercut configuration. The housing 20 further has a sealing ring 2.

A (removable) ear cushion 10 has a ring plate 1 at its first side 1*a* and a (soft) material 11 of the ear cushion at its second side 1*b*. The first side 1*a* with the hard ring plate 1 is fixed to the housing 20. The housing 20 can be for example in the form of a resonator. In this case the (hard) ring plate 1 is put on to the sealing ring 2 and the ring plate 1 is latched by means of the latching hooks 21 in such a way that the ring plate 1 bears against the sealing ring 2 under an (axial) prestressing.

Assembly of the ear cushion is effected by placement of the ear cushion on the housing in the correct position, in which case the hard ring plate is latched in or at the latching hooks 21. To remove the ear cushion the ear cushion only has to be pulled in the axial direction. Advantageously no relative movement takes place between the ring plate 1 and the sealing ring 2 so that it is possible to avoid damage to those parts.

Although a hard ring plate has been described in the first embodiment, in accordance with the invention the ear cushion can also be fixed to the housing by means of screwing. For that purpose the ring plate 1 has a screwthread in order thus to be screwed into the latching hooks or into the undercut configuration 21. As an alternative thereto the housing 20 can have a screwthread at its circumference so that the ring plate can be screwed on, into the screwthread. As an alternative thereto fixing of the ear cushion to the housing can be effected by means of a bayonet fastening. A further possible form of fixing represents glueing the ear cushion in place, but that configuration suffers from the disadvantage that the ear cushion cannot be readily replaced.

FIG. 3 shows a sectional view of an earphone or a headset in accordance with the second embodiment. The second embodiment is based substantially on the first embodiment. The housing 20 serves to receive an electroacoustic transducer 50 and at its outside region has a plurality of latching hooks 21 or an at least partially circumferentially extending latching ring or an undercut configuration. An ear cushion 10 of the earphone has an ear cushion substance or an ear cushion material 11, a first side 1*a* towards the housing 20 and a second side 1*b* towards the ear. In addition the ear cushion 10 has a ring plate1 at the first side. The ring plate can be made from a hard material.

The further configuration of the earphone in accordance with the second embodiment corresponds to the configuration of the earphone in accordance with the first embodiment.

Thus an acoustically closed region 4 can be provided in the housing 20. That acoustic closure effect can be provided for example by the configuration of the ring plate 1 in combination with the receiving ring 2 and the latching hook 21.

A seal involving hard-on-hard relationship can be implemented by the configuration of the preferably hard ring plate 1 and the preferably hard sealing ring 2 as well as the latching hook 21. That is particularly advantageous because the geometry of the ear cushion and therewith also the acoustic properties of the earphone are not altered thereby.

The invention claimed is:

1. An earphone comprising:

a housing for receiving an electroacoustic transducer, and an ear cushion unit having an ear cushion material and a first closed ring, the first closed ring having a first edge with an inner diameter and a second edge with an outer diameter, a side of the first closed ring sealed to a side of the ear cushion material to provide a closed sealed region, wherein the housing has a closed sealing ring and a latching unit, wherein the first closed ring has a prestressing on an entire contact area between the first closed ring and the closed sealing ring when it is placed in direct contact with the closed sealing ring and held by means of the latching unit, wherein the first edge of the first closed ring is pressed against the closed sealing ring and the second edge is held by the latching unit to enable a good sealing relationship between the ear cushion and the housing.

2. An earphone as set forth in claim 1 wherein the first closed ring is in the form of a hard ring plate.

3. An earphone as set forth in claim 2 wherein the hard ring plate engages into the latching unit and bears against the closed sealing ring in such a way that the hard ring plate represents a spring subjected to a force.

4. An earphone as set forth in claim 1 wherein the first closed ring has an axial prestressing when it is placed on the closed sealing ring and held by means of the latching unit.

5. A headset comprising:

a housing for receiving an electroacoustic transducer, and an ear cushion unit having an ear cushion material and a first closed ring, the first closed ring having a first edge with an inner diameter and a second edge with an outer diameter, a side of the first closed ring sealed to a side of the ear cushion material to provide a closed sealed region, wherein the housing has a closed sealing ring and a latching unit, wherein the first closed ring has a prestressing on an entire contact area between the first closed ring and the closed sealing ring when it is placed in direct contact with the closed sealing ring and held by means of the latching unit, wherein the first edge of the first closed ring is pressed against the closed sealing ring and the second edge is held by the latching unit to enable a good sealing relationship between the ear cushion and the housing.

6. A headset as set forth in claim 5 wherein the first closed ring is in the form of a hard ring plate.

7. A headset as set forth in claim 6 wherein the hard ring plate engages into the latching unit and bears against the closed sealing ring in such a way that the hard ring plate represents a spring subjected to a force.

8. A headset as set forth in claim 5 wherein the first closed ring has an axial prestressing when it is placed on the closed sealing ring and held by means of the latching unit.

9. An earphone as set forth in claim 1, wherein the latching unit is circular and comprises a plurality of equally spaced latching hooks.

10. A headset according to claim 5, wherein the latching unit is circular and comprises a plurality of equally spaced latching hooks.

* * * * *

UNITED STATES PATENT AND TRADEMARK OFFICE

CERTIFICATE OF CORRECTION

PATENT NO. : 8,369,557 B2
APPLICATION NO. : 12/427588
DATED : February 5, 2013
INVENTOR(S) : Kuhtz et al.

It is certified that error appears in the above-identified patent and that said Letters Patent is hereby corrected as shown below:

In the Specification:

In column 1, line 9, please add -- for all purposes -- after "entirety."

In column 1, line 13, please add a -- , -- after "For example."

In column 1, line 17, please add a -- , -- before and after "however."

In column 1, line 23, please add a -- , -- after "addition."

In column 1, line 25, please add a -- , -- after "addition."

In column 1, line 27, please add a -- , -- after "Accordingly."

In column 1, line 41, please add a -- , -- after "Thus."

In column 1, line 49, please add a -- , -- after "Thus."

In column 1, line 56, please add a -- , -- after "invention."

In column 1, line 67, please delete "ear cushion" and insert -- ear cushions --.

In column 2, line 5, please add a -- , -- after "case."

In column 2, line 7, please add a -- , -- after "arrangement."

In column 2, lines 8-9, please add a -- , -- after "transducer."

In column 2, line 10, please add a -- , -- after "Optionally."

In column 2, line 16, please add a -- , -- after "arrangement."

In column 2, line 19, please add a -- , -- after "case."

In column 2, line 25, please add a -- , -- after "Thus."

In column 2, line 33, please delete "drawing" and insert -- drawings --.

In column 2, line 49, please bold the "1" in "1a."

In column 2, line 52, please add a -- , -- after "Accordingly."

In column 2, line 57, please add a -- , -- before and after "for example."

In column 2, line 61, please add a -- , -- after "21."

Signed and Sealed this
Fifteenth Day of October, 2013

Teresa Stanek Rea
*Deputy Director of the United States Patent and Trademark Office*

In column 3, line 4, please add a -- , -- before and after “for example.”

In column 3, line 8, please add a -- , -- after “invention.”

In column 3, line 11-12, please add a -- , -- after “Furthermore.”

In column 3, line 26, please add a -- , -- before and after “for example.”

In column 3, line 27, please add a -- , -- after “case.”

In column 3, line 36, please add a -- , -- after “Advantageously.”

In column 3, line 40, please add a -- , -- after “invention.”

In column 3, line 42, please delete the word “thus.”

In column 3, line 44, please add a -- , -- after “thereto.”

In column 3, line 46, please add a -- , -- after “thereto.”

In column 3, line 53, please add a -- , -- after “headset.”

In column 3, line 62, please add a -- , -- after “addition.”

In column 3, line 63, please delete “plate1” and insert -- plate 1 --.

In column 4, line 1, please add a -- , -- after “Thus.”

In column 4, line 3, please add a -- , -- before and after “for example.”